United States Patent [19]

Crandall

[11] Patent Number: 4,828,950

[45] Date of Patent: May 9, 1989

[54] METHOD FOR MAKING MULTI-COLOR REPRODUCTIONS ON PLAIN BOND PAPER

[75] Inventor: Robert P. Crandall, Webster, N.Y.

[73] Assignee: Eastman Kodak Company, Rochester, N.Y.

[21] Appl. No.: 137,896

[22] Filed: Dec. 28, 1987

[51] Int. Cl.[4] ..... G03G 13/01; G03G 13/22

[52] U.S. Cl. ..... 430/45; 430/47

[58] Field of Search ..... 430/45, 47

[56] References Cited

U.S. PATENT DOCUMENTS 3,275,436 9/1966 Mayer ..... 430/126
3,773,507 11/1973 Sato et al. .
4,312,932 1/1982 Hauser et al. ..... 430/41

FOREIGN PATENT DOCUMENTS 54-18736 2/1979 Japan ..... 430/45

OTHER PUBLICATIONS

Schaffert, R. M., *Reprographics,* Sep., 1966, pp. 16–19.

*Primary Examiner*—Paul R. Michl
*Assistant Examiner*—Jeffrey A. Lindeman
*Attorney, Agent, or Firm*—Lawrence P. Kessler

[57] ABSTRACT

Method of making electrostatographic multi-color reproductions on plain bond paper receiver sheets in such a manner that the sheets have the high quality look of coated paper while not being subject to the coated paper problems of blistering and differences in gloss level build up. According to the method of this invention, electrostatographically formed color images of information to be reproduced are respectively developed with corresponding colored marking particles, and a negative image of the information to be reproduced is developed with white marking particles. The marking particle developed images are sequentially transferred to a plain bond paper receiver sheet in superimposed register. The transferred images are then fixed to the receiver sheet by application of heat and/or pressure. The white marking particles cover the area of the receiver sheet not covered by the colored marking particles. Since substantially the entire surface area of the receiver sheet is covered with marking particles, after fixing of the marking particles to the receiver sheet, the sheet has a high quality glossy appearance without any appreciable relief effect due to differences in gloss level build up.

3 Claims, 1 Drawing Sheet

METHOD FOR MAKING MULTI-COLOR REPRODUCTIONS ON PLAIN BOND PAPER

BACKGROUND OF THE INVENTION

This invention relates in general to making multi-color reproductions, and more particularly to electrostatographically making multi-color reproductions on plain bond paper receiver sheets in such a manner that the sheets have the high quality look of coated paper.

In making multi-color reproductions, high quality coated papers are often used as receiver sheets to give the finished reproduction a desirable surface appearance. Such appearance has a substantial perceived value in that it gives the multi-color reproductions a glossy finish.

Electrostatographic apparatus have recently been developed to make multi-color reproductions. With such apparatus, electrostatic charge patterns corresponding to color separation images are respectively developed with appropriately colored marking particles. The marking particle-developed images are then transferred in superimposed register to a receiver sheet and fixed to such sheet by heat and/or pressure to form a permanent reproduction. When the receiver sheets are of the coated paper type certain unique problems arise. Specifically, the necessary heat required to be applied to the coated sheet to effect fixing of the multiple layers of marking particles to such sheet may result in a blistering of the sheet coating. Of course this blistering renders the reproduction unacceptable. Furthermore, there may be a difference in gloss level built up on the sheet. That is, the gloss level of the marking particle image on the coated sheet can create an objectionable relief effect on the sheet surface.

SUMMARY OF THE INVENTION

This invention is directed to a method of making electrostatographic multi-color reproductions on plain bond paper receiver sheets in such a manner that the sheets have the high quality look of coated paper while not being subject to the coated paper problems of blistering and differences in gloss level build up. According to the method of this invention, electrostatographically formed color images of information to be reproduced are respectively developed with corresponding colored marking particles, and a negative image of the information to be reproduced is developed with white marking particles. The marking particle developed images are sequentially transferred to a plain bond paper receiver sheet in superimposed register. The transferred images are then fixed to the receiver sheet by application of heat and/or pressure. The white marking particles cover the area of the receiver sheet not covered by the colored marking particles. Since substantially the entire surface area of the reciever sheet is covered with marking particles, after fixing of the marking particles to the receiver sheet, the sheet has a high quality glossy appearance without any appreciable relief effect due to differences in gloss level build up.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
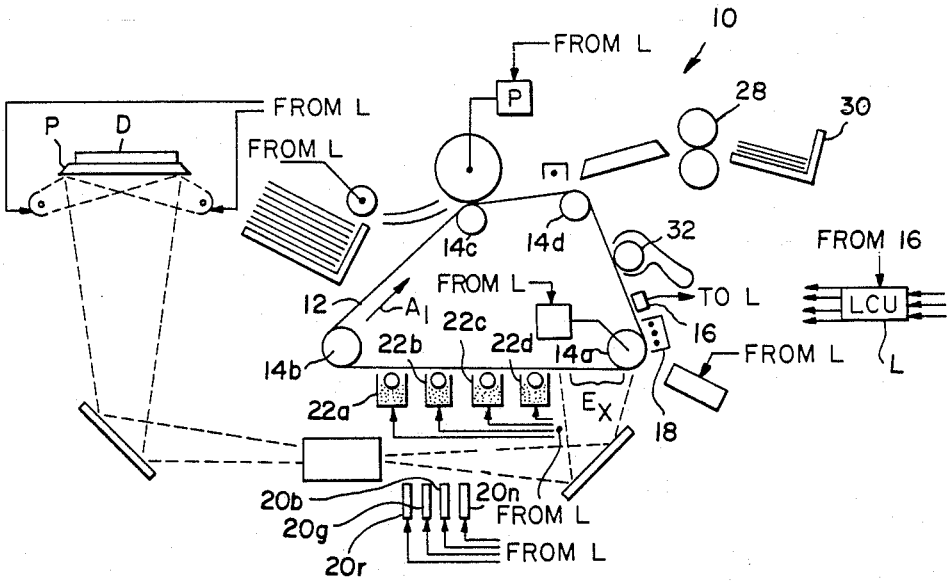
FIG. 1 is a schematic illustration of an electrostatographic reproduction apparatus capable of functioning according to the method of this invention.

Referring now to the accompanying drawings, FIG. 1 schematically shows an exemplary electrostatographic reproduction apparatus, designated by the numeral 10, capable of functioning according to this invention. The apparatus 10 includes an endless dielectric web 12 supported by rollers 14*a*–14*d*. One of the rollers (e.g. roller 14*a*) is driven by motor M to move the web 12 about a closed loop path in the direction of arrow A. The web 12 is a composite structure having a photoconductive surface layer with a plurality of successive image receiving areas and a grounded conductive support layer such as shown for example in U.S. Pat. No. 3,615,414 (issued Oct. 26, 1971 in the name of Light). Of course, other electrostatographic reproduction apparatus, such as those employing a photoconductive drum for example, are suitable for use with this invention.

Typical electrostatographic process stations are located about the periphery of the web 12 in operative relation with the image receiving areas. Control of the reproduction apparatus 10 and the electrostatographic process stations are accomplished by a logic and control unit L including a microprocessor for example. The microprocessor receives operator input signals and timing signals, for example from sensor 16 detecting movement of the web 12 about its closed loop path. Based on such signals and a program for the microprocessor, the unit L produces signals to control the timing operation of the various electrostatographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

The electrostatographic process stations function in the following manner to produce copies of multi-color information. A corona charger 18, coupled to a D.C. or biased A.C. electrical potential source (not shown), applies a uniform electrostatic charge to the web 12 as it moves past the charger. The uniform charge, in successive adjacent image receiving areas of the web, is altered as the web passes through zone $E_x$ to form respective latent image-wise charge patterns in such areas corresponding to images of the information to be copied. For example, color separation latent image-wise charge patterns are formed by exposure of the image-receiving area of the web, respectively through color filters 20*r*, 20*g*, 20*b*, to reflected light images of a multi-color document D located on a transparent platen P. Of course, formation of image-wise charge patterns on the web may be alternately accomplished by other suitable methods such as by exposure to electronically (e.g. LED array or laser scanner) or electrostatically produced images. Further, with other electrostatographic reproduction apparatus which do not employ a photoconductive web, the formation of the latent image charge patterns need not be accomplished in successive image areas.

Travel of the web 12 brings the areas bearing the latent charge patterns into a development zone having a plurality of developer stations 22*a*–22*c*. The developer stations may be of the magnetic brush type such as described in U.S. Pat. No. 3,543,720 issued Nov. 1, 1970, in the name of Drexler et al, respectively containing colored marking particles. If for example, the charge patterns correspond respectively to red, green, and blue color separation images, the colored marking particles in the respective developer stations are cyan, magenta and yellow. Such marking particles exhibit a triboelectric charge of a polarity opposite to that of the charge patterns to be developed. Under the control of the logic and control unit L, the developer stations 22*a*–22*c* are actuated to bring their associated marking particles into contact with corresponding charge patterns so that the marking particles adhere to the image areas to respectively develop the charge patterns with the appropriately colored marking particles. That is, the charge pattern corresponding to the red color separation image is developed with cyan marking particles, the charge pattern corresponding to the green color separation image is developed with magenta marking particles, and the charge pattern corresponding to the blue color separation image is developed with yellow marking particles. Of course, other schemes for producing color developed images are suitable for use with this invention.

According to this invention, an additional developer station 22*d* is provided in the reproduction apparatus 10 adjacent to the developer stations 22*a*–22*c*. The developer station 22*d*, which is, for example, of substantially the same construction as the developer stations 22*a*–22*c*, contains white marking particles which exhibit a triboelectric charge of the same polarity as that of the charge pattern to be developed. A non-filtered (or neutral density filtered), full color, reflected light image of the document D is formed and exposes the web 12 in an image area sequential to the previously exposed areas to form a corresponding charge pattern in the such image area. This charge pattern is developed with the white marking particles from developer station 22*d*. Since the white marking particles have the same polarity as the charge pattern, the particles adhere to the background portion of the charge pattern to form, in effect, a negative image of the document D.

The marking particle developed images (colored and white) are sequentially transferred in accurate superimposed register to a plain paper receiver sheet to form a multi-color reproduction of the information to be reproduced. To effect the transfer operation, a receiver sheet is transported from a stack 24 to a transfer device 26, such as an electrically biased transfer roller of the type shown in U.S. Pat. Application Ser. No. 939,840, filed Dec. 9, 1986 in the name of Roy et al, for example. The sheet is tacked to the transfer device 26 and, in timed relation with the passage of the web areas bearing the developed images presents the sheet in nip relation with the web to transfer the marking particles in superimposed register to the sheet.

After the transfer of the last of the successive marking particle images to the receiver sheet, the sheet is detacked from the transfer device and transported to a fixing apparatus 28 where the marking particles are fused to the sheet by heat and/or pressure for example. The receiver sheet bearing the multi-color reproduction is then delivered to an output hopper 30 for operator retrieval. While the marking particles are being fixed to the sheet, the web continues to travel about its closed loop path through a cleaning mechanism 32 where any residual marking particles are removed, and then returned to the vicinity of the charger 18 where it is ready for reuse in the reproduction process.

Figure 2:
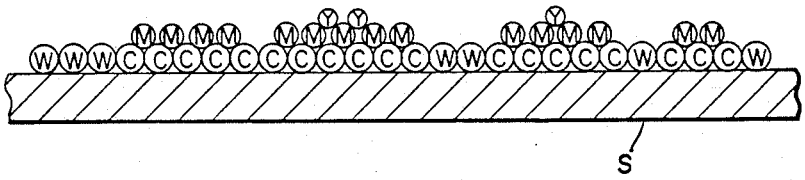
FIG. 2 is a side elevational view, in cross-section, of a plain bond paper receiver sheet having a multi-color reproduction formed thereon according to the method of this invention.

Since the white marking particle developed image corresponds to a negative image of the information being reproduced, as shown in FIG. 2 the transferred white marking particles W substantially cover those areas of the receiver sheet S to which no colored marking particles (designated by the letters C, M, Y) have been transferred. Thus the overall level of the marking particle build up on the receiver sheet is more even than in prior reproduction schemes so that the relief effect is substantially reduced. Moreover, after the transferred marking particle images are fused, the marking particles covering the entire surface of the sheet exhibit a high gloss appearance which gives the finished reproduction a high quality look similar to that which it would have if made on coated paper.

The invention has been described in detail with particular reference to preferred embodiments thereof, but is will be understood that variations and modifications can be effected within the spirit and scope of the invention.

I claim:

1. Method for electrostatographically making multicolor reproductions on plain bond paper receiver sheets, said method comprising the steps of:

electrostatographically producing colored marking particle developed images respectively corresponding to color images of information to be reproduced;

electrostatographically producing a negative image, of such information to be reproduced, developed with white marking particles;

transferring said marking particle developed images to a receiver sheet of plain bond paper in superimposed register so that substantially the entire surface area of said sheet is covered with marking particles; and fixing all of the transferred images to said sheet by application of heat and/or pressure.

2. The invention of claim 1 wherein said marking particle developed images are sequentially produced in adjacent areas of a dielectric member, and wherein said marking particle developed images are sequentially transferred to said receiver sheet.

3. The invention of claim 2 wherein the step of electrostatographically producing said marking particle developed images includes the steps of:

uniformly charging said dielectric member;

sequentially exposing adjacent areas of said dielectric member respectively to color separation images and a full color image of information to be reproduced to form corresponding charge patterns in such areas of said dielectric member; and adhering corresponding colored and white marking particles respectively to such charge patterns, wherein the colored marking particles exhibit a charge of opposite polarity to that of the uniform charge placed on the dielectric member so as to adhere to the image areas of the charge patterns respectively corresponding to the color separation images, and the white marking particles exhibit a charge of the same polarity as that of the uniform charge placed on the dielectric member so as to adhere to the background areas of the charge pattern corresponding to the full color image.

* * * * *